US008500416B2

(12) United States Patent
Ophardt et al.

(10) Patent No.: US 8,500,416 B2
(45) Date of Patent: Aug. 6, 2013

(54) DOUBLED SEAL DISK FOR PISTON PUMP

(75) Inventors: Heiner Ophardt, Vineland (CA); Ali Mirbach, Issum (DE)

(73) Assignee: Gotohti.com, Beamsville (CA)

( * ) Notice: Subject to any disclaimer, the term of this patent is extended or adjusted under 35 U.S.C. 154(b) by 620 days.

(21) Appl. No.: 12/658,760

(22) Filed: Feb. 16, 2010

(65) Prior Publication Data

US 2010/0232997 A1 Sep. 16, 2010

(30) Foreign Application Priority Data

Mar. 10, 2009 (CA) ..... 2657695

(51) Int. Cl.

| | |
|---|---|
| ***F04B 5/00*** | (2006.01) |
| ***F04B 53/12*** | (2006.01) |
| ***B65D 88/54*** | (2006.01) |
| ***G01F 11/00*** | (2006.01) |
| ***B67D 7/58*** | (2010.01) |
| ***F01B 3/00*** | (2006.01) |

(52) U.S. Cl.
USPC ..... 417/245; 417/553; 222/321.8; 222/383.1; 92/112

(58) Field of Classification Search
USPC ..... 417/245, 259, 320, 553, 562, 567, 417/569; 222/321.1, 321.6–321.9, 383.1, 222/181.1–181.3, 385; 92/110, 112
See application file for complete search history.

(56) References Cited

U.S. PATENT DOCUMENTS

| | | | | |
|---|---|---|---|---|
| 5,165,577 | A | 11/1992 | Ophardt | |
| 5,282,552 | A | 2/1994 | Ophardt | |
| 5,373,970 | A | 12/1994 | Ophardt | |
| 5,489,044 | A | 2/1996 | Ophardt | |
| 5,676,277 | A * | 10/1997 | Ophardt | 222/83 |
| 5,975,360 | A * | 11/1999 | Ophardt | 222/83 |
| 6,409,050 | B1 * | 6/2002 | Ophardt et al. | 222/181.1 |
| 6,601,736 | B2 | 8/2003 | Ophardt | |
| 6,957,751 | B2 | 10/2005 | Ophardt | |
| 7,267,251 | B2 | 9/2007 | Ophardt | |
| 7,303,099 | B2 | 12/2007 | Ophardt | |
| RE40,319 | E | 5/2008 | Ophardt | |
| 7,377,405 | B2 | 5/2008 | Ophardt | |
| 7,556,178 | B2 | 7/2009 | Ophardt | |
| 8,157,134 | B2 * | 4/2012 | Ophardt et al. | 222/321.7 |
| 8,365,965 | B2 * | 2/2013 | Ophardt | 222/321.8 |
| 2005/0205600 | A1 | 9/2005 | Ophardt | |
| 2006/0237483 | A1 | 10/2006 | Ophardt | |
| 2006/0249538 | A1 * | 11/2006 | Ophardt et al. | 222/181.3 |
| 2007/0257064 | A1 | 11/2007 | Ophardt | |

FOREIGN PATENT DOCUMENTS

EP 1 604 600 A2 12/2005

* cited by examiner

*Primary Examiner* — Devon Kramer
*Assistant Examiner* — Bryan Lettman
(74) *Attorney, Agent, or Firm* — Thorpe North & Western LLP

(57) ABSTRACT

A pump assembly in the context of a piston pump having a piston carrying a disk which extends radially outwardly to engage a wall of a chamber to substantially prevent fluid flow in one direction and yet permit deflection of the disk away from the wall of the chamber to permit flow in the other direction; the improvement in which two or more of similar such disks are provided spaced axially adjacent one another.

17 Claims, 8 Drawing Sheets

DOUBLED SEAL DISK FOR PISTON PUMP

SCOPE OF THE INVENTION

This invention relates generally to a pump assembly and, more particularly, to a disposable plastic pump assembly.

BACKGROUND OF THE INVENTION

Many pump assemblies are known for dispensing fluid including those disclosed in the applicant's U.S. Pat. No. 5,489,044 to Ophardt issued Feb. 6, 1996, the disclosure of which is incorporated herein by reference. Such fluid pumps are preferably for use with a wide variety of fluids to be dispensed which fluids have a wide variety of properties. These fluids can include alcohol and alcohol solutions, water and water based soaps and cleaners, thick creams as, for example, hand creams and facial creams and highly viscous fluids and pastes, such as toothpaste and pumice containing flowable hand cleaning compositions. These fluids have different viscosities. For example, alcohol and alcohol solutions have a low viscosity, many of the soap-like water based cleaners have a viscosity comparable to water itself whereas the thick creams may have a much higher viscosity and the extremely thick fluid or pastes, such as toothpaste, can have a very high viscosity.

The applicant has appreciated a difficulty with known disposable plastic pumps that, different pumps need to be manufactured to provide for dispensing of fluids having different properties notably different viscosities. The present applicant has appreciated that for some pumps having the same pump configuration, three different pumps are required to be manufactured with one for low viscosity solutions containing alcohol, a second for water based cleaning solutions and a third for thick creams and very viscous fluids.

In the operation of a piston pump having a flexible disk which must deflect away from a chamber wall to permit fluid to flow therepast, the viscosity of the fluid being dispensed can have a significant impact on the extent to which disk engages a wall of a chamber in which it is disposed so as on one hand to prevent flow of liquid therepast in normal operation of the pump to dispense fluid and on the other hand to permit vacuum evacuation of air therepast as in a step in a typical preparation for use of a bottle carrying the pump with at least some fluids. For example, providing engagement of a disk with a circumferential wall of a chamber so as to provide a seal against, for example, alcohol leaking thereby will also provide a seal past which it will be difficult to evacuate air using a vacuum. As a contrary example, when used for dispensing relatively thick fluid, cream or paste, there is a low tendency of the thick cream to leak past a disk on a piston engaging a cylindrical wall of a chamber and, thus, what might be considered a relatively leaky disk in the context of an alcohol fluid or water based cleaner may be an acceptable disk for use in a pump dispensing a relatively thick fluid or cream. The relatively leaky disk in the context of a relatively viscous cream can be acceptable in use of the pump for dispensing without risk of leaking of the relatively thick fluid, cream or paste and assist in permitting evacuation of air past the disk by reducing the pressures necessary to evacuate air effectively.

The present inventor has also appreciated that many piston pumps with a piston carrying a disk to seal with a cylindrical wall of a chamber with some fluids suffer the disadvantage that they can be prone to leakage when used with some fluids, particularly those of low viscosity.

The above-mentioned U.S. Pat. No. 5,489,044 teaches filling a reservoir with fluid, applying a pump assembly to the outlet of the reservoir and using a vacuum to evacuate air from the reservoir. This is advantageous for a number of reasons. Eliminating air from the reservoir can increase shelf life of the fluid as may be desired or necessary in the case of certain bio-degradable soaps, foods and pharmaceuticals. In the case of higher viscosity fluids, such as thick creams and pastes which are typically filled with the container upright, a difficulty arises when air remains in the container after filling. On inversion of the container after filling for use the fluid may have a sufficiently high viscosity that the air in the container does not rise upwardly in the container to above the fluid. Rather, the air becomes entrapped in the fluid and as the fluid is dispensed through the pump, the air becomes presented to the inlet of the pump and the air must be pumped out before further dispensing of the desired fluid resumes. A user on finding that air is being dispensed assumes that the reservoir is empty of fluid or that the pump mechanism is not working. To overcome this problem, it is particularly desired with thick fluids, creams and pastes that the container be evacuated of air before use. In order to evacuate air from the container, a vacuum can be applied to the container across a seal disk. If the seal disk is to provide a strong seal as against fluids such as alcohol or water based cleaning solutions leaking then a high vacuum below atmospheric is required to evacuate air past the disk. Thus, the present applicant has appreciated the disadvantage of a pump assembly suitable for use in dispensing alcohol is not suitable for use in dispensing thicker fluids particularly those in which air or other gases will not flow upwardly due to gravity alone. A product vendor needs to make or purchase and stock, with a disadvantage of increased cost, two different pumps.

SUMMARY OF THE INVENTION

To at least partially overcome these disadvantages of previously known devices, the present invention provides in the context of a piston pump having a piston carrying a disk which extends radially outwardly to engage a wall of a chamber to substantially prevent fluid flow in one direction and yet permit deflection of the disk away from the wall of the chamber to permit flow in the other direction, the improvement in which two or more of similar such disks are provided spaced axially adjacent one another.

An objection of the present invention is to provide an improved piston pump assembly.

Another object of the present invention is to provide a piston pump assembly adapted for use with a wide range of different fluids including fluids of different viscosities.

In one aspect, the present invention provides a pump for dispensing liquid from a source of fluid comprising:

a piston chamber-forming member having an inner cylindrical chamber and an outer cylindrical chamber, the inner chamber and outer chamber each having a diameter, a chamber wall, an inner end and an outer end, the diameter of the inner chamber being substantially constant, the diameter of the inner chamber being either the same as or different than the diameter of the outer chamber, the inner chamber and outer chamber being coaxial with the outer end of the inner chamber opening into the inner end of the outer chamber, the inner end of the inner chamber in fluid communication with the source of fluid, a piston-forming element having an inner end and an outer end, the piston-forming element received in the piston chamber-forming member axially slidable inwardly and outwardly therein, said piston-forming element having an axially extending stem, an inner disk on the stem, the inner disk extending radially outwardly from the stem to proximate the chamber wall of the inner chamber circumferentially thereabout, a first intermediate disk on the stem spaced axially outwardly from the inner disk and extending radially outwardly from the stem to proximate the chamber wall of the inner chamber circumferentially thereabout, an outer disk on the stem spaced axially outwardly from the first intermediate disk and extending radially outwardly from the stem to proximate the chamber wall of the outer chamber circumferentially thereabout, the stem having a central passageway therethrough from an inlet to an outlet, the inlet located on the stem between the first intermediate disk and the outer disk in communication with the passageway, the outlet located on the stem proximate the outer end of the piston-forming element, the piston-forming element slidably received in the piston chamber-forming member for reciprocal axial inward and outward movement therein between a retracted position and an extended position in a cycle of operation during which the inner disk is maintained in the inner chamber, the first intermediate disk is maintained in the inner chamber, and the sealing disk is maintained in the outer chamber, during each such cycle of operation:

(a) the inner disk substantially preventing fluid flow in the inner chamber past the inner disk in an inward direction, (b) the first intermediate disc substantially preventing fluid flow in the inner chamber past the first intermediate disk in an inward direction, (c) the outer disk substantially preventing fluid flow in the outer chamber past the outer disk in an outward direction (d) the inner disk elastically deforming away from the chamber wall of the inner chamber to permit fluid flow in the inner chamber past the inner disk in an outward direction, (e) the first intermediate disk elastically deforming away from the chamber wall of the inner chamber to permit fluid flow in the inner chamber past the first intermediate disk in an outward direction.

BRIEF DESCRIPTION OF THE DRAWINGS

Further aspects and advantages of the present invention will become apparent from the following description taken together with the accompanying drawings in which.

DETAILED DESCRIPTION OF THE DRAWINGS

Figure 1:
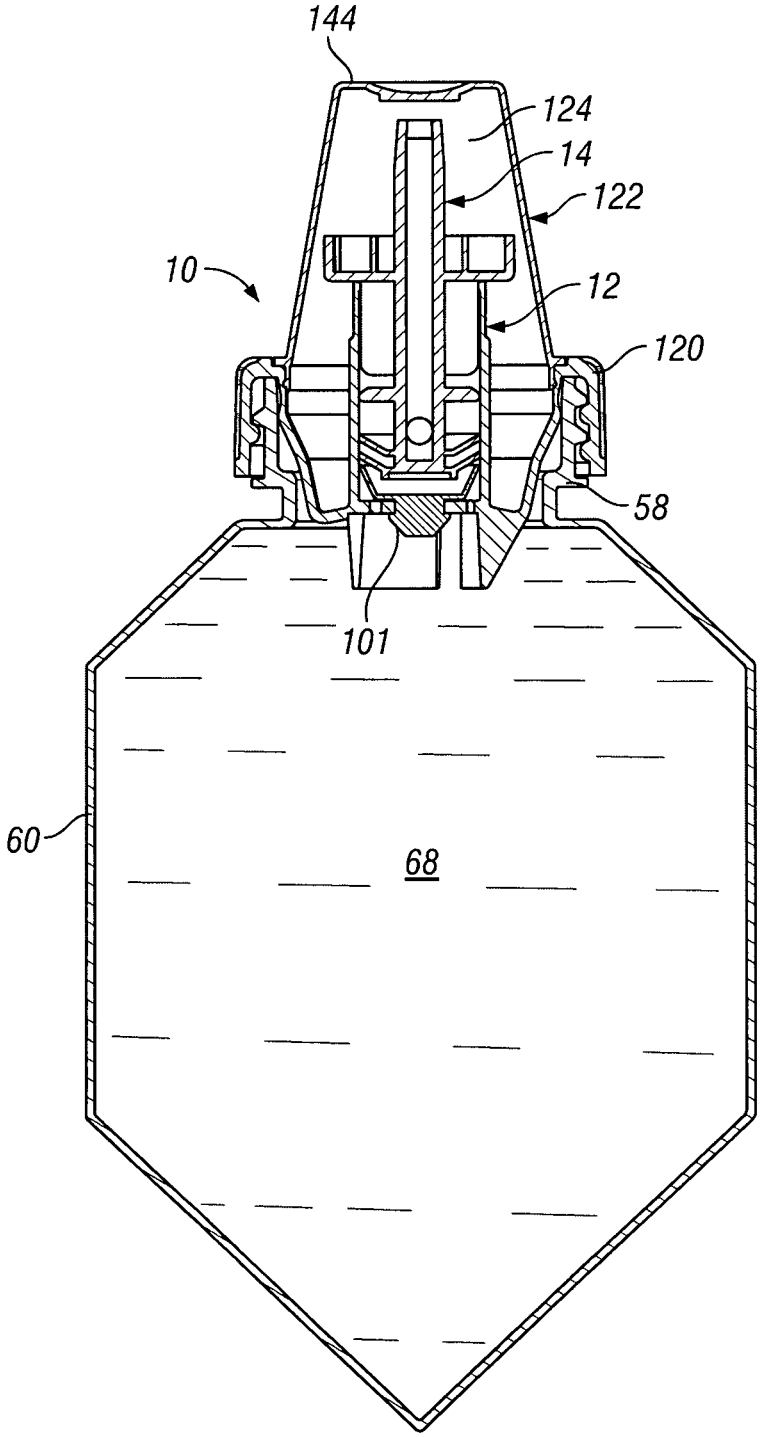
FIG. 1 is a cross-sectional side view of a first preferred embodiment of a liquid reservoir and pump assembly in accordance with the present invention in an upright position.
Figure 2:
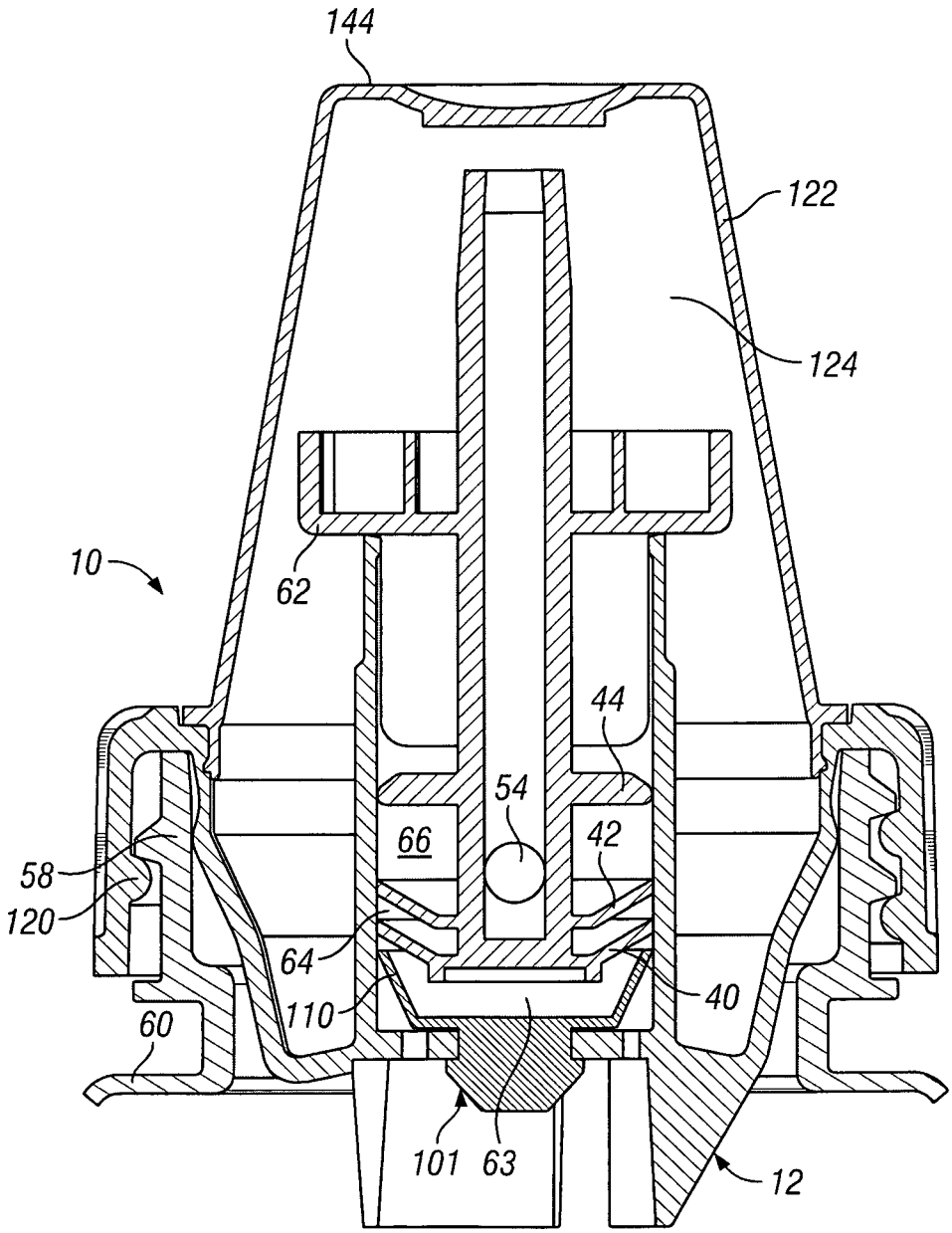
FIG. 2 is an enlarged view of portions of FIG. 1.

Reference is made to FIG. 1. FIGS. 1 and 2 which illustrate a fluid reservoir or container 60 to which a pump assembly 10 is coupled. The container 60 is preferably collapsible and is open only at an outlet opening through a neck 58. The pump assembly 10 comprises a piston chamber-forming body 12, a piston 14 and a cap 122. The body 12 is secured to the neck 58 as by having an annular collar 120 of the body 12 sealably engage onto the neck 58. Upstanding from the annular collar 120 is the cap 122 which is removable and sealably engages annularly about the collar 120 extending upwardly therefrom to form an enclosed compartment 124. The cap 122 has an exhaust port 144. FIGS. 1 and 2 show the combination of the container 60 and its pump assembly 10 filled with a fluid 68 in an upright position in which the combination is normally filled and stored before use.

Figure 3:
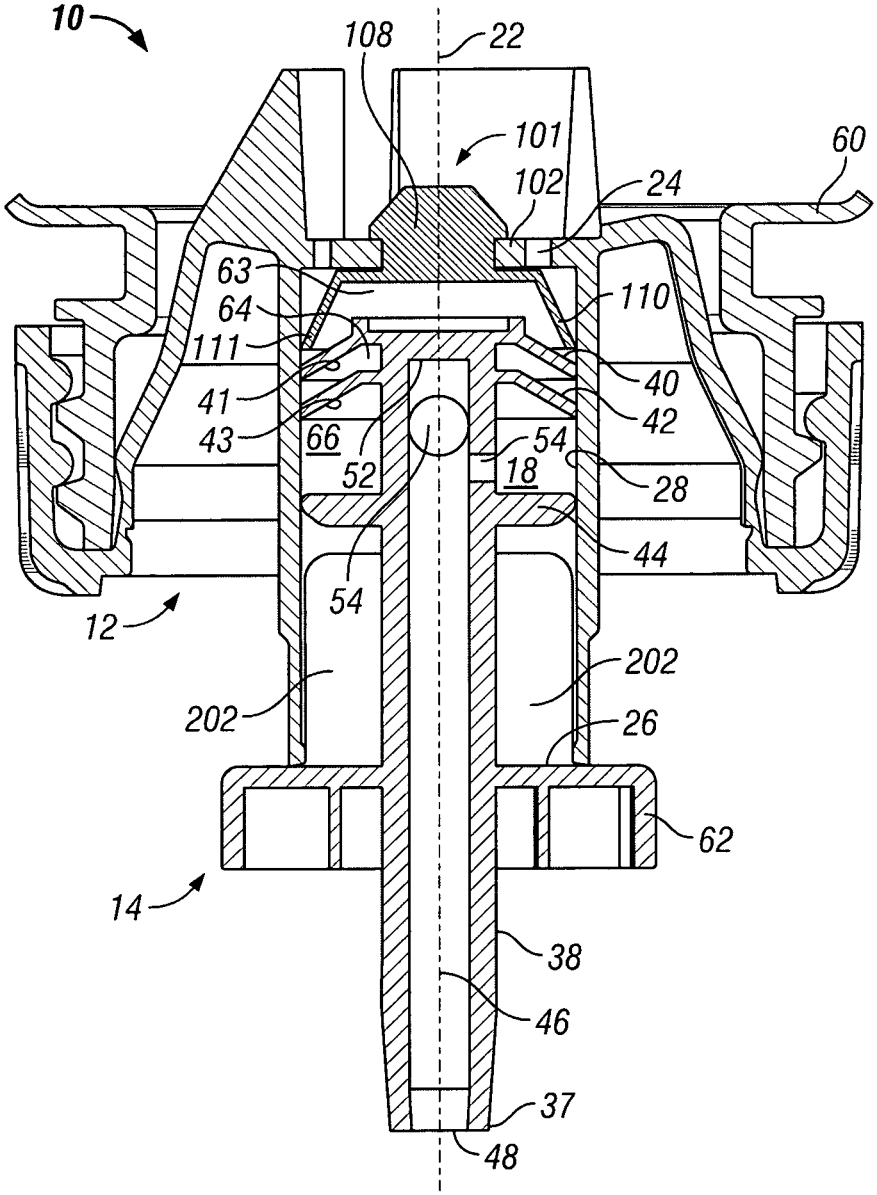
FIG. 3 is a cross-sectional side view of the assembled pump assembly of FIG. 1 showing the piston inverted and in a fully retracted position.
Figure 4:
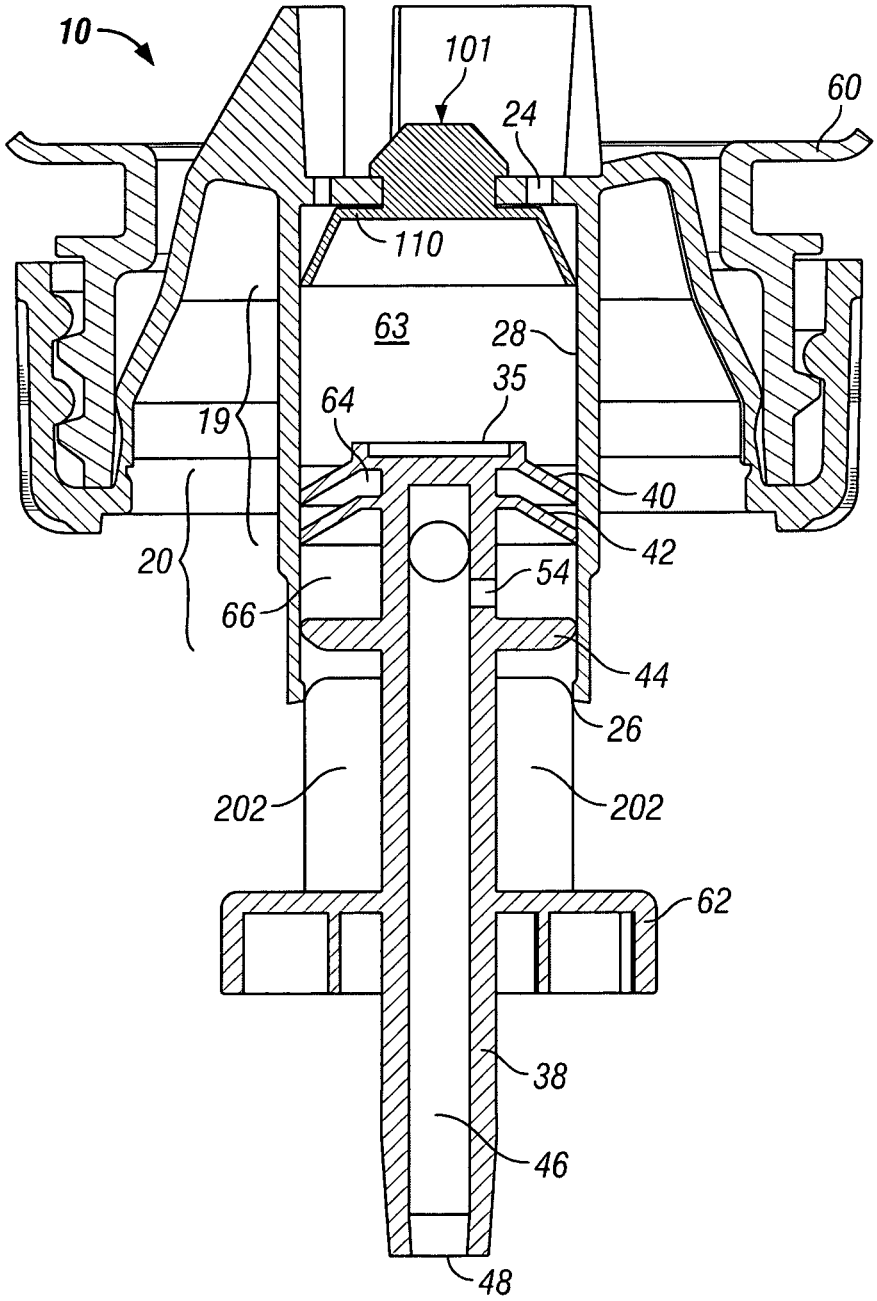
FIG. 4 is a cross-sectional side view similar to FIG. 3 but with the piston in a fully extended position.

For use in dispensing the combination shown in FIG. 1 typically has its cap 122 removed and the combination is then inverted and coupled to a dispensing mechanism which holds the container 60 and the pump assembly 10 in an inverted position as shown in FIGS. 3 and 4. Such dispensing mechanisms may be of the type described in above-mentioned U.S. Pat. No. 5,489,044. The dispensing mechanism provides for relative reciprocal sliding of the piston 14 relative the body 12 to dispense the fluid 68 from the container 60.

Reference is made first to FIGS. 3 and 4 which best show the pump assembly 10 of FIGS. 1 and 2 as comprising two principal elements, the piston chamber-forming body 12 and the piston 14.

Referring to FIGS. 3 and 4, body 12 has a cylindrical chamber 18 coaxially disposed about an axis 22. The chamber 18 has an inlet opening 24 and an outlet opening 26. The chamber 18 has a cylindrical chamber side wall 28.

The piston 14 has an inner end 35 and an outer end 37. The piston 14 is axially slidably received in the body 12. The piston 14 has an elongate stem 38 upon which four disks are provided at axially spaced locations. An inner disk 40 is provided proximate the innermost end 35 of the piston spaced axially from an intermediate disk 42 which, in turn, is spaced axially from an outer disk 44. The inner disk 40, intermediate disk 42 and outer disk 44 are adapted to be axially slidable within the chamber 18. Each of the inner disk 40, intermediate disk 42 and outer disk 44 extend radially outwardly from the stem 38 so as to be adapted to sealably engage the side wall 28 of the chamber 18.

The inner disk 40 extends radially outwardly from the stem 38 to proximate the side wall 28 of the inner chamber 18 circumferentially thereabout. The inner disk 40 has an elastically deformable edge portion 41 for engagement with the side wall 28 of the chamber which edge portion 41 elastically deforms away from the side wall 28 of the chamber 18 to permit fluid flow in the chamber 18 past the inner disk 40 in an outward direction. The edge portion 41 has an inherent bias to assume an inherent condition in which the edge portion forms a seal with the side wall 28 of the chamber 18 to substantially prevent fluid flow in the chamber 18 past the inner disk 40 in an inward direction. In this regard, the elastically deformable edge portion 41 preferably assumes an inherent position with the edge portion 41 in engagement with the side wall 28 of the chamber 18 to which inherent position the edge portion 41 is biased. Insofar as the pressure differential across the inner disk 40 is such that the pressure on the inner side of the inner disk 40, as in a compartment 63, is less than the pressure on the outer side of the inner disk 40, as in a compartment 64 between the inner disc 40 and the intermediate disc 42, then this pressure differential will with the inner disk 40 assuming its inherent position provide engagement between the inner disk 40 and the side wall 28 of the chamber 18 to substantially prevent fluid flow in the chamber 18 past the inner disk 40 in an inward direction.

If the pressure differential across the inner disk 40 is such that the pressure on the outer side of the disk 40 in the compartment 64 is less than the pressure on the inner side of the disk 40, as in the compartment 63, then provided such pressure differential is sufficiently great, then the edge portion 41 of the inner disk will be elastically deformed from an inherent position out of engagement with the side wall 28 of the chamber 18 permitting fluid flow in the inner chamber 18 past the inner disk 40 in an outward direction.

The intermediate disk 42 similarly has an elastically deformable edge portion 43 for engagement with side wall 28 of chamber 18 and to substantially prevent fluid flow in the chamber 18 past the intermediate disk 42 in an inward direction yet with the intermediate disk elastically deforming, by reason of elastic deformation of its edge portion 43, away from the side wall 28 of the chamber 18 to permit fluid flow in the chamber 18 past the intermediate disk 42 in an outer direction.

The outer disk 44 in engagement with the side wall 28 of the chamber 18 and arranged in a manner to substantially prevent fluid flow in the chamber 18 past the outer disk 44 in an outward direction. The outer disk 44 shown sealably engages the side wall 28 of the chamber 18 to prevent fluid flow in the chamber 18 past the outer disk 44 in an outward direction, or in an inward direction.

An outermost portion of the stem 38 is hollow with a central passageway 46 extending from an outlet 48 at the outermost end 37 of the stem 38 centrally through the stem 38 to a closed inner end 52. Radially extending inlets 54 extend radially through the stem into the passageway 46, with the inlets 54 being provided on the stem in between the outer disk 44 and the intermediate disk 42.

The piston 14 carries an engagement flange or disk 62 on the stem outward from the outer disk 44. The engagement disk 62 is provided for engagement by an activating device (not shown) in order to move the piston 14 in and out of the body 12.

An end wall 102 is provided across the inner end of the chamber 18. The end wall 102 has the inlet openings 24 for passage of fluid therethrough between the container 60 and the chamber 18. A one-way valve 101 is secured to the end wall 102. The one-way valve 101 is integrally formed from elastomeric material with a shoulder button 108 which is secured in a snap-fit inside a central opening through the end wall 102. The one-way valve has an annular disk 110 which extends radially outwardly for engagement with the side wall 28 of the chamber 18. The disk 110 engages the side wall 28 of the chamber 18 to provide a seal therewith in a similar manner to the inner disk 40. A peripheral outer portion 111 of the disk 110 is adapted to engage the side wall 28 of the chamber 18 in a manner similar to that of the inner disk 40 so as to permit fluid flow outwardly therepast in the chamber 18 yet substantially prevent fluid flow inwardly therepast from the chamber 18 to the reservoir 60.

The piston 14 forms, as defined between the inner disk 40 and the intermediate disk 42, the annular compartment 64 which opens radially outwardly as an annular opening between the disks 40 and 42. Similarly, the piston 14 forms between the intermediate disk 42 and the outer disk 44 the compartment 66 which opens radially outwardly as an annular opening between the disks 42 and 44. Between the annular disk 110 and the inner disk 40, the annular compartment 63 is formed in the chamber 18.

As seen in FIG. 4, in the chamber 18, the inner disk 40 and intermediate disk 42 are axially slidable in an inner portion 19 of the chamber 18 and the outer disk 44 is axially slidable in an outer portion 20 of the chamber 18.

FIGS. 3 and 4 show radially and axially extending locating members 202 carried on the stem 38 which are to engage the side wall 28 of the chamber 18 to assist in maintaining the piston 14 coaxially in the chamber 18.

Reference is now made to FIGS. 3 and 4 to describe a cycle of operation in which the piston 14 is moved: in an extension stroke from the retracted position of FIG. 3 to the extended position of FIG. 4; and in a retraction stroke from the extended position of FIG. 4 to the retracted position of FIG. 3.

As seen in the preferred embodiment of FIGS. 3 and 4, while not necessary, in every position which the piston 14 can assume during the cycle of operation between each of FIGS. 3 and 4, each of the inner disk 40 and the intermediate disk 42 engages the side wall 28 of the chamber 18 in the inner portion 19 and prevents fluid flow inwardly therepast; the outer disk 44 engages the side wall 28 of the chamber 18 in the outer portion 20 and prevents fluid flow outwardly therepast, and the outlet 48 of the central passageway 46 is in communication with the outer compartment 66 via the passageway 46 and inlet 54.

In operation of the pump as illustrated in FIGS. 3 and 4, in an extension stroke, on moving the pump outwardly, a partial vacuum is created in compartment 63 such that fluid is drawn from the reservoir 60 past the one-way valve disk 110 into the compartment 63 within the chamber 18 between the one-way valve disk 110 and the inner disk 40. In a retraction stroke on moving the piston 14 inwardly, fluid in the compartment 63 between the one-way valve disk 110 and the inner disc 40 is pressurized deflecting the inner disk 40 for displacement of fluid outwardly past the inner disk 40 into the compartment 64. Fluid displaced outwardly past the inner disk 40 comes to be received between the inner disk 40 and the intermediate disk 42 in turn creating a pressure which displaces fluid from between the inner disk 40 and the intermediate disk 42 outwardly past the intermediate disk 42 into the compartment 66. The fluid displaced outwardly past the intermediate disk 42 passes to between the intermediate disk 42 and the outer disk 44 and out through the inlets 54 to the passageway 46, through the passageway 46 and out the outlet 48.

As described in above-noted U.S. Pat. No. 5,489,044, in the operation of filling the container 60, the container when in the inverted position as shown in FIGS. 1 and 2 is filled with a quantity of fluid. The pump assembly 10 and its cap 122 are then applied. Any excess air which remains in the reservoir 60 is withdrawn from the reservoir by applying a vacuum pressure to the opening 144 through the cap 122. In applying vacuum pressure to the compartment 124 inside the cap 122, air is drawn out of the bottle 60. The vacuum required to draw air past the inner disk 40 and the intermediate disk 42 will be less than the vacuum pressure required to draw the liquid past merely the inner disk 40. Preferably, a vacuum is applied to the opening 144 adequate to draw air past the disks 40 and 42 but insufficient to draw fluid past either or both disks 40 and 42. Once all the air is drawn out then, on the fluid coming to engage the disk 40 or 42, the vacuum will not be sufficient to draw the fluid past the disks 40 or 42.

Figure 5:
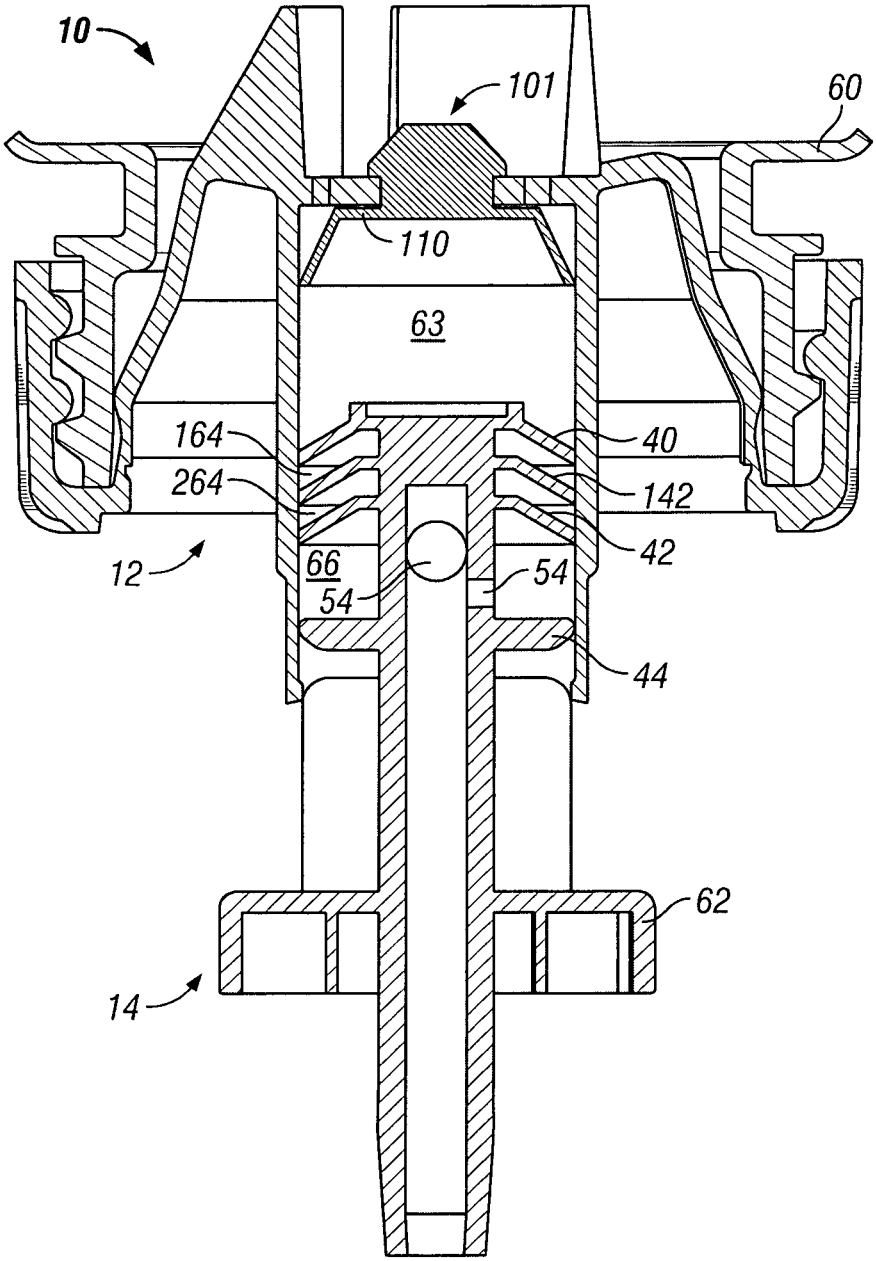
FIG. 5 is a cross-sectional side view of a pump assembly in accordance with a second embodiment of the present invention.

Reference is made to FIG. 5 which illustrates a pump assembly in accordance with a second embodiment of the present invention which is identical to the pump assembly in FIGS. 3 and 4 with the exception that an additional intermediate disk 142 is provided. The embodiment of FIG. 5 thus provides in addition to the inner disk 40 and the first intermediate disk 42, a second intermediate disk 142 located therebetween with the second intermediate disk 142 being identical to the first intermediate disk 42. The operation of the pump illustrated in FIG. 5 is identical to that illustrated in the embodiment of FIGS. 3 and 4, however, the inner compartment 64 in FIGS. 3 and 4 becomes divided in FIG. 5 by disk 142 into two compartments, a compartment 164 and a compartment 264. Fluid is drawn inwardly into the compartment 63 past the disk 110 due to relative vacuum being created in the compartment 63 in a withdrawal stroke. In a retraction stroke, pressurizing of fluid in the compartment 63 will cause fluid to be forced past the inner disk 40 to the intermediate compartment 164 creating pressure causing fluid to be forced past the second intermediate disk 142 into the compartment 264 and hence past the first intermediate disk 42. While the embodiment of FIG. 5 illustrates two intermediate disks 42 and 142, it is to be appreciated that plurality of such intermediate disks can be provided.

Figure 6:
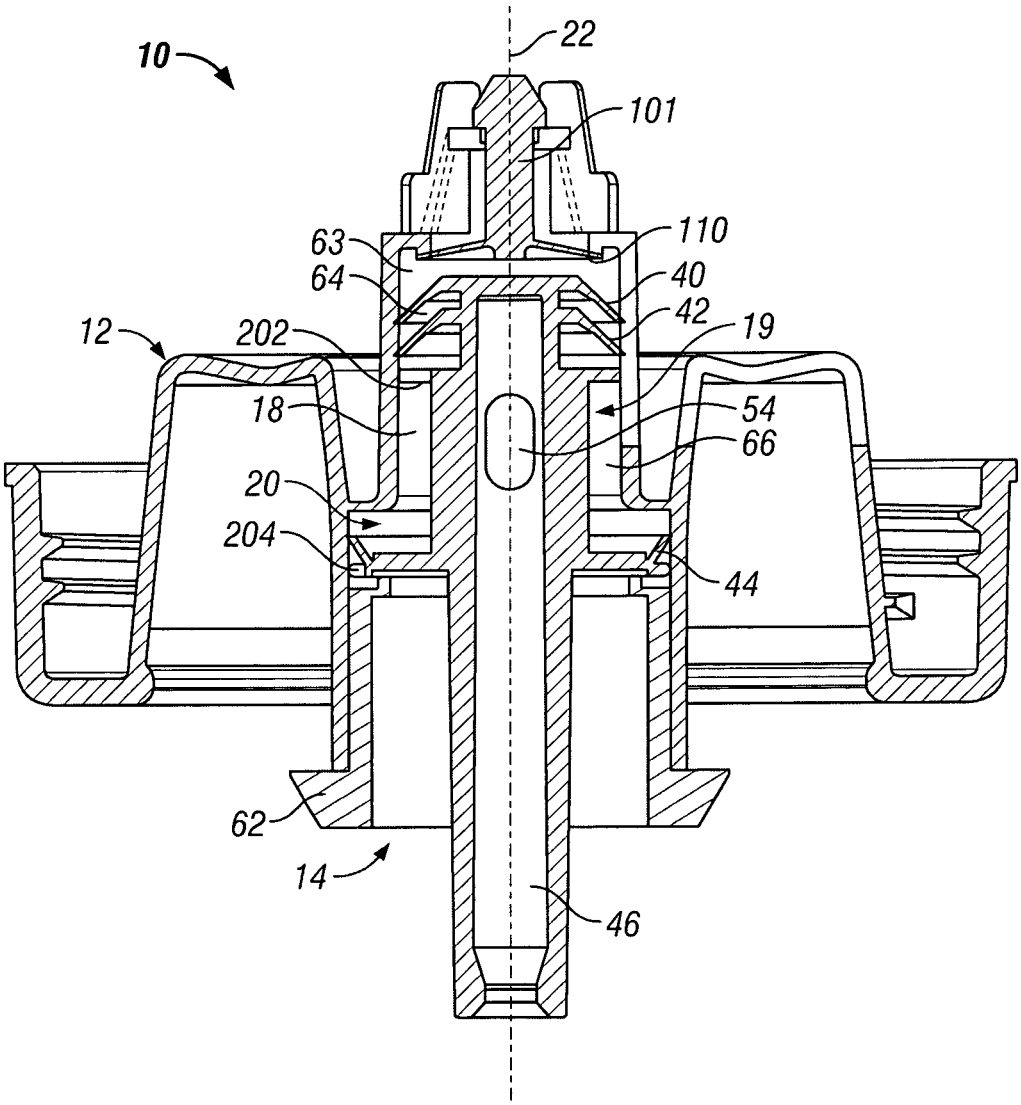
FIG. 6 is a cross-sectional side view of a pump assembly in accordance with a third embodiment of the present invention.

Reference is made to FIG. 6 which shows a third embodiment of a pump assembly. The embodiment of FIG. 6 has an arrangement substantially the same as that shown in FIGS. 1 to 4, however, the chamber 18 in FIGS. 1 to 4 which is of a constant diameter is replaced by a stepped chamber 18 in FIG. 6 having an inner chamber portion or inner chamber 19 of a smaller diameter than an outer chamber portion or outer chamber 20. The inner chamber 19 and outer chamber 20 are coaxial about the axis 22. In the pump of FIG. 6, the enlarged diameter outer chamber 20 assists in drawing back fluid in the passageway 46 in a retraction stroke as can be advantageous to prevent dripping.

Figure 7:
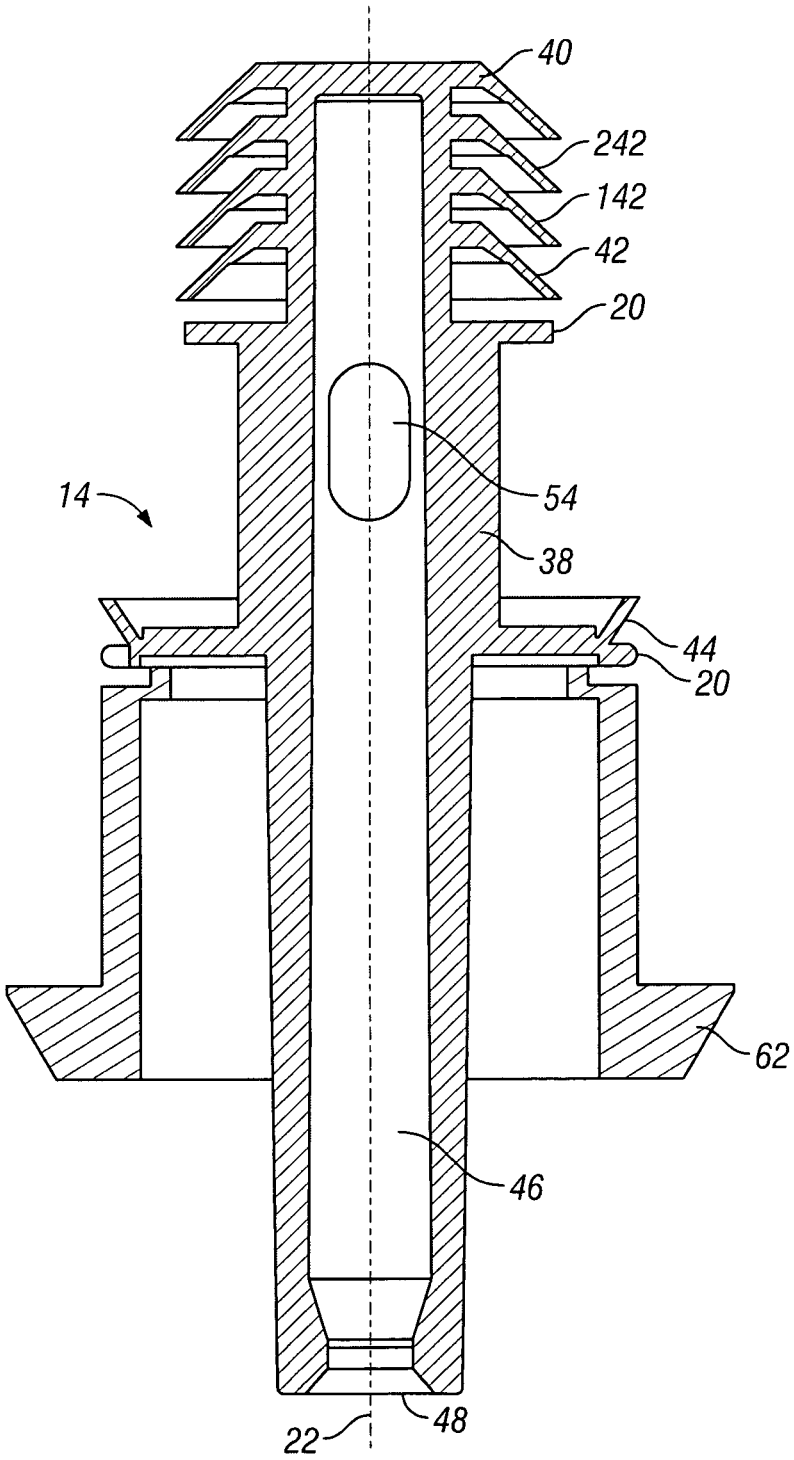
FIG. 7 is a cross-sectional side view of a piston for a pump assembly similar to the piston shown in FIG. 6.

FIG. 7 illustrates a piston substantially the same as that shown in FIG. 6, however, having rather than merely the inner disk 40 and an intermediate disk 42 two additional intermediate disks 142 and 242 are provided such that each of the inner disks 40 and the three intermediate disks 42, 142 and 242 are axially spaced adjacent to each other and substantially identical, and each are to be located in the inner chamber 19.

FIGS. 6 and 7 show two locating disks 204 and 202 which engage the walls of the inner chamber 19 and the outer chamber 20, respectively, yet have axially extending openings therethrough to permit passage of fluid axially therepast. These locating disks assist in locating the piston coaxially in within the chamber 18 of the body 12.

Figure 8:
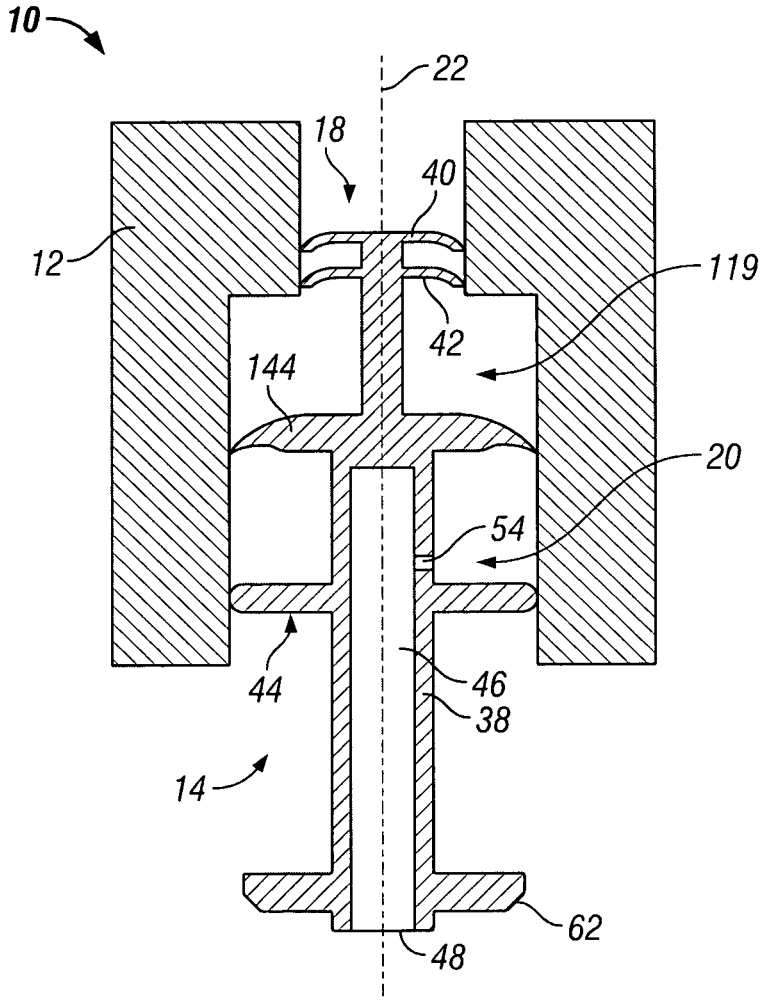
FIG. 8 is a cross-sectional side view of a pump assembly in accordance with a fourth embodiment of the present invention.

Reference is made to FIG. 8 which shows another stepped chamber 18 in which the inner disk 40 and intermediate disk 42 are received in the inner chamber 19 of a first smaller diameter and the outer disk 44 is received in a larger diameter outer chamber 20. A middle disk 144 is provided in the outer chamber 20 between the outer disk 44 and the intermediate disk 42. This middle disk 144 cooperates with the outer disk 44 and the two disks 40 and 42 in the inner chamber 19 so as to provide a pumping arrangement avoiding the need, for example, for the separate one-way valve 110 shown in FIG. 5. Middle disk 144, like disks 40 and 42, prevents fluid flow inwardly therepast and has a resilient deformable edge portion 145 which elastically deforms away from a side wall 36 of the outer chamber 20 to permit fluid flow inwardly therepast. In a retraction stroke, fluid is pressurized between disks 144 and 42 to force fluid outwardly past the disk 144. In an extension stroke, a vacuum is created between disks 144 and 42 drawing fluid outwardly.

In the various embodiments shown in the Figures, the inner disk 40 on the piston has been duplicated once by the intermediate disk 42 in FIGS. 1 to 4 and 6, twice by the disk 42 and 142 in FIG. 5 and three times by the disk 42, 142 and 242 in FIG. 7. This duplication is by one or more similar axially spaced disk relatively closely adjacent to each other and received in a section of the chamber of the same diameter.

The duplication of the inner disk 40 is advantageous towards ensuring an enhanced sealing arrangement through the chamber 18 past the combination of inner disk 40 and each of its duplicates 42, 142 and/or 242. In this regard, the applicant has appreciated many factors which give rise to imperfect sealing of a disk such as inner disk 40 with a side wall 26 of a chamber 18. These factors include: imperfections in the side wall 26 of the chamber 18, as due to drafting and tapering of the side wall 26 when manufactured by injection moulding; pits occurring in the side wall 26 due to wear of the wall or the wear of an internal coating on the side wall 26 or imperfect applications of such an internal coating; the piston 14 assuming positions relative the chamber 18 in which the disks are not coaxial with the chamber 18; and the disks which are intended to be resiliently biased into the side wall 26 coming to lose their resiliency and/or to creep or become deformed so as to not be engaged with the side wall 26. Insofar as the piston 14 has not only the inner disk 40 but also at least one duplicate axially spaced disc 42 for engagement with the side wall 26, there is an increased probability that an adequate seal will be formed by one of the two duplicate disks. With an increased possibility that one of the disks 40 or 42 will form a seal, the need to have but a single disc 40 alone form a seal with high probability is avoided and thus each of the disk 40 and its duplicate disc 42 may be selected, for example, to each form a seal less resistant to leakage. In the context of an alcohol solution or a cleaning fluid having a viscosity relatively similar to water, the duplicate disks 40 and 42 can provide adequate seals to resist leakage in use in dispensing yet these same disks can permit vacuum evacuation of air therepast at lesser vacuums below atmospheric than a single disk which must be designed to alone resist alcohol or water leakage on a probability basis.

A pump which such duplicate disks 40 and 42 has been found suitable for use, both in respect of dispensing and in respect of vacuum evacuation, with alcohol solutions or cleaning solutions having a viscosity similar to water and also with thick fluidy creams and pastes of viscosity significantly high that air will not flow upwardly therein under gravity forces alone.

The present inventor has found that pumps with a single disk 40 suitable for sealing alcohol solutions or cleaning solutions with a viscosity comparable to water has required high vacuum pressures, for example, in excess of 600 mb Hg below atmosphere to adequately exhaust air, which vacuum pressures are generally considered high and stress other components of the pump assembly in use. A pump in accordance with the present invention with duplicated disks 40 and 42 has been found adequate to seal alcohol solutions and cleaning solutions with a viscosity comparable to water yet to permit air evacuation under considerably less vacuum pressure, for example, 300 and less mb Hg below atmosphere.

The duplication of the disk 40 has been shown in the preferred embodiments as a duplication of an innermost disk on a piston. The invention is not so limited and the duplication of a disk may be provided on other sealing disks found on a piston including, for example, the disk 44 in FIG. 7 or disk 144 in FIG. 8. The disk which is to be duplicated is preferably the disk which is most subject to causing actual dripping from the outlet and typically this is an innermost disk on a piston.

In the embodiments illustrated, the one-way valve 101 is shown as including a disc 110. The ability of the disk 110 to resist fluid flow therepast outwardly is preferably to be less than the ability of the disk 40 to resist fluid flow therepast outwardly. The one-way valve 101 shown may be replaced by many other one-way valve devices and the invention is not limited to use of the one-way valve 101 shown.

The invention is adapted for use with either collapsible or non-collapsible containers, preferably with the non-collapsible containers having a mechanism for vacuum relief when used such as a vent.

While the invention has been described with reference to preferred embodiments, many variations and modifications will now occur to a person skilled in the art. For a definition of the invention, reference is made to the following claims.

We claim:

1. A pump for dispensing liquid from a source of fluid comprising:

a piston chamber-forming member having an inner cylindrical chamber and an outer cylindrical chamber, the inner chamber and outer chamber each having a diameter, a chamber wall, an inner end and an outer end, the diameter of the inner chamber being substantially constant, the diameter of the inner chamber being either the same as or different than the diameter of the outer chamber, the inner chamber and outer chamber being coaxial with the outer end of the inner chamber opening into the inner end of the outer chamber, the inner end of the inner chamber in fluid communication with the source of fluid, a piston-forming element having an inner end and an outer end, the piston-forming element received in the piston chamber-forming member axially slidable inwardly and outwardly therein, said piston forming element having an axially extending stem, an inner disk on the stem, the inner disk extending radially outwardly from the stem to proximate the chamber wall of the inner chamber circumferentially thereabout, a first intermediate disk on the stem spaced axially outwardly from the inner disk and extending radially outwardly from the stem to proximate the chamber wall of the inner chamber circumferentially thereabout, an outer disk on the stem spaced axially outwardly from the first intermediate disk and extending radially outwardly from the stem to proximate the chamber wall of the outer chamber circumferentially thereabout, the stem having a central passageway therethrough from an inlet to an outlet, the inlet located on the stem between the first intermediate disk and the outer disk in communication with the passageway, the outlet located on the stem spaced axially outward of the outer disk proximate the outer end of the piston-forming element, the piston-forming element slidably received in the piston chamber-forming member for reciprocal axial inward and outward movement therein between a retracted position and an extended position in a cycle of operation during which the inner disk is maintained in the inner chamber, the first intermediate disk is maintained in the inner chamber, and the outer disk is maintained in the outer chamber, during each such cycle of operation:

(a) the inner disk substantially preventing fluid flow in the inner chamber past the inner disk in an inward direction, (b) the first intermediate disc substantially preventing fluid flow in the inner chamber past the first intermediate disk in an inward direction, (c) the outer disk substantially preventing fluid flow in the outer chamber past the outer disk in an outward direction (d) the inner disk elastically deforming away from the chamber wall of the inner chamber to permit fluid flow in the inner chamber past the inner disk in an outward direction, and (e) the first intermediate disk elastically deforming away from the chamber wall of the inner chamber to permit fluid flow in the inner chamber past the first intermediate disk in an outward direction.

2. A pump as claimed in claim 1 wherein:

the inner disk having an elastically deformable edge portion for engagement with the chamber wall of the inner chamber which edge portion elastically deforms away from the chamber wall of the inner chamber to permit fluid flow in the inner chamber past the inner disk in an outward direction, and the first intermediate disk having an elastically deformable edge portion for engagement with the chamber wall of the inner chamber which edge portion elastically deforms away from the chamber wall of the inner chamber to permit fluid flow in the inner chamber past the first intermediate disk in an outward direction.

3. A pump as claimed in claim 1 wherein:

the piston-forming element being generally cylindrical in cross-section, each of the inner disk, first intermediate disk and outer disk being circular in cross-section.

4. A pump as claimed in claim 1 wherein the diameter of the inner chamber is the same as the diameter of the outer chamber, a one-way valve is provided between the fluid source and the inner chamber permitting fluid flow through the inner end of the inner chamber only from the fluid source to the inner chamber.

5. A pump as claimed in claim 4 wherein in a cycle of operation including a first stroke of inward axial movement and a reciprocal second stroke of outward axial movement of the piston forming element axially within the piston-chamber forming member wherein:

in one of said first and second strokes: fluid is drawn from the source of fluid past the one-way valve to between the one-way valve and the inner disk, and in the other of said first and second strokes: (a) fluid between the one-way valve and the inner disk is displaced past the inner disk to between the inner disk and the first intermediate disk, (b) fluid between the inner disk and the first intermediate disk is displaced past the first intermediate disk to between the first intermediate disk and the outer disk, and (c) fluid between the first intermediate disk and the outer disk is displaced through the inlet into the passageway, and through the passageway to exit the outlet.

6. A pump as claimed in claim 1 wherein the diameter of the inner chamber is less than the diameter of the outer chamber.

7. A pump as claimed in claim 6 wherein an inner end of the outer chamber comprises an annular shoulder opening into the outer end of the inner chamber, the outer disk engaging said annular shoulder to limit inward sliding of the piston-forming element inward into the piston chamber-forming member.

8. A pump as claimed in claim 1 wherein the diameter of the inner chamber is greater than the diameter of the outer chamber.

9. A pump as claimed in claim 8 wherein:

an outer end of the inner chamber comprises an annular shoulder opening into the inner end of the outer chamber, said first intermediate disc engaging said annular shoulder to limit outward sliding of the piston-forming element outward out of the piston chamber-forming member.

10. A pump as claimed in claim 1 wherein the piston-forming element has an element comprising at least the inner disk, the first intermediate disk, the outer disk and an inner portion of the stem carrying the inner disk, the first intermediate disk and, the outer disk which element consists of a unitary element formed entirely of plastic by injection molding.

11. A pump as claimed in claim 1 including a second intermediate disk on the stem spaced axially between the inner disk and the first intermediate disk and extending radially outwardly from the stem to proximate the chamber wall of the inner chamber circumferentially thereabout, during each such cycle of operation:

the second intermediate disk substantially preventing fluid flow in the inner chamber past the second intermediate disk in an inward direction, and the second intermediate disk elastically deforming away from the chamber wall of the inner chamber to permit fluid flow in the inner chamber past the second intermediate disk in an outward direction.

12. A pump as claimed in claim 11 wherein:

the inner disc having an elastically deformable edge portion for engagement with the chamber wall of the inner chamber which edge portion elastically deforms away from the chamber wall of the inner chamber to permit fluid flow in the inner chamber past the inner disk in an outward direction, the first intermediate disk having an elastically deformable edge portion for engagement with the chamber wall of the inner chamber which edge portion elastically deforms away from the chamber wall of the inner chamber to permit fluid flow in the inner chamber past the inner first intermediate disk in an outward direction, and the second intermediate disk having an elastically deformable edge portion for engagement with the chamber wall of the inner chamber which edge portion elastically deforms away from the chamber wall of the inner chamber to permit fluid flow in the inner chamber past the second intermediate disk in an outward direction.

13. A pump as claimed in claim 12 wherein the diameter of the inner chamber is the same as the diameter of the outer chamber, a one-way valve is provided between the fluid source and the inner chamber permitting fluid flow through the inner end of the inner chamber only from the fluid source to the inner chamber.

14. A pump as claimed in claim 13 wherein in a cycle of operation including a first stroke of inward axial movement and a reciprocal second stroke of outward axial movement of the piston-forming element axially within the piston-chamber forming member wherein:

in one of said first and second strokes: fluid is drawn from the source of fluid past the one-way valve to between the one-way valve and the inner disk, and in the other of said first and second strokes: (a) fluid between the one-way valve and the inner disk is displaced past the inner disk to between the inner disk and the first intermediate disk, (b) fluid between the inner disk and the second intermediate disk is displaced past the second intermediate disk to between the second intermediate disk and the first intermediate disk, (c) fluid between the second intermediate disk and the first intermediate disk is displaced past the first intermediate disk to between the first intermediate disk and the outer disk, and (d) fluid between the first intermediate disk and the outer disk is displaced through the inlet into the passageway, and through the passageway to exit the outlet.

15. A pump as claimed in claim 1 further including an engagement member on said stem outward of the outer disc for engagement to move the piston-forming element inwardly and outwardly relative the piston chamber-forming member.

16. A pump as claimed in claim 1 further including a locating member on said stem extending radially outwardly from the stem to engage said chamber wall of the inner chamber or the outer chamber and guide the piston-forming element in sliding axially centered and aligned within the inner chamber.

17. A pump as claimed in claim 1 wherein the inner disk is on the stem proximate the inner end of the piston-forming element.

* * * * *